US006648444B2

(12) United States Patent
Valero et al.

(10) Patent No.: US 6,648,444 B2
(45) Date of Patent: Nov. 18, 2003

(54) HIGH THROUGHPUT PARALLEL DROP DETECTION SCHEME

(75) Inventors: Jose Luis Valero, Sant Cugat del Valles (ES); Francesc Subirada, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/987,574

(22) Filed: Nov. 15, 2001

(65) Prior Publication Data

US 2003/0090534 A1 May 15, 2003

(51) Int. Cl.[7] ..... B41J 29/393
(52) U.S. Cl. ..... 347/19
(58) Field of Search ..... 347/19, 23, 14, 347/43, 81, 10, 12, 11, 6, 20, 22, 5, 16, 30; 358/296

(56) References Cited

U.S. PATENT DOCUMENTS 5,430,306 A * 7/1995 Ix ..... 250/573
6,224,183 B1 5/2001 Kono et al. ..... 347/19
6,350,006 B1 * 2/2002 Muller et al. ..... 347/19

* cited by examiner

*Primary Examiner*—Stephen D. Meier
*Assistant Examiner*—Charles W. Stewart, Jr.
(74) *Attorney, Agent, or Firm*—Lee & Hayes, PLLC

(57) ABSTRACT

The present invention is directed to a method and apparatus for testing the operational status of printhead nozzles. High throughput drop detection devices are used to detected ink drops that are fired from the printhead nozzles, and the operational status is determined from the ink drop characteristics. The ink drop characteristics may include the presence or absence of an ink drop. Ink drop characteristics may also include the size and the location of an ink drop. The drop detection devices are capable of detecting a plurality of ink drops that are ejected substantially simultaneously.

24 Claims, 6 Drawing Sheets

HIGH THROUGHPUT PARALLEL DROP DETECTION SCHEME

FIELD OF THE INVENTION

This invention relates generally to ink jet printers and more particularly to drop detection arrangements for increasing the rate at which ink jet printhead nozzles are examined.

BACKGROUND OF THE INVENTION

It is generally known to use drop detection devices to examine the operational status of printhead nozzles in ink jet printers. Some ink jet printers have a plurality of printheads. Drop detection devices are used to test the operational status of ink-ejection nozzles of a printhead. Depending on the test results, corrective measures may be implemented for proper operation.

Generally, drop detection devices are used to detect ink drops ejected by printhead nozzles. Based on the detection of ink drops, the status of a particular nozzle may be diagnosed. Typically, a printhead ejects ink drops in response to drive signals generated by print control circuitry in a printer. A printhead that ejects ink drops in response to drive signals may be referred to as a drop on demand printhead. Typically, there are two commonly used drop on demand technologies. These technologies are thermal (or bubble-jet) inkjet printing and piezo-electric (or impulse) inkjet printing. In thermal inkjet printing, the energy for ink drop ejection is generated by resistor elements, which are electrically heated. Such elements heat rapidly in response to electrical signals controlled by a microprocessor and creates a vapor bubble that expels ink through one or more nozzles associated with the resistor elements. In piezo-electric inkjet printing, ink drops are ejected in response to the vibrations of a piezo-electric crystal. The piezo-electric crystal responds to an electrical signal controlled by a microprocessor.

Nozzles through which ink drops are ejected may become clogged with paper fibers or other debris during normal operation. The nozzles may also become clogged with dry ink during prolonged idle periods. Generally, printhead service stations are used for wiping the printhead and applying suction to the printhead to clear out any blocked nozzles. The ink drop detectors may be used to determine whether a printhead actually requires cleaning. Additionally the detectors may be used to detect permanent failures of individual nozzles that may be caused, for example, by the failure of heating elements (in thermal ink jets) or by the failure in the piezo-electric crystals (in impulse printers). Drop detection devices may also be used to calibrate the nozzle position relative to other parts of the printing machine.

Well known drop detectors include optical drop detection circuits. Optical drop detection circuits typically include a light sensor such as a photodiode that senses the light provided by a light source such as a light emitting diode (LED). When a drop is present in the light path between the light sensor and the light source, the output of the light sensor changes because the amount of light sensed by the light sensor is reduced by the presence of the ink drop. The output of the light sensor is typically amplified and analyzed to determine whether an ink drop passed through the path between the light source and the light sensor.

It is generally well known to include optical drop detection devices in inkjet printers. For example, the DESIGNJET™ 1050 and the DESIGNJET™ 5000 both include optical drop detection technology. As used in the DESIGNJET™ 1050 and the DESIGNJET™ 5000, the drop detector is placed in the printer next to the service station. When drop detection is to be done, the carriage moves to position the printhead over the drop detection device. When the first printhead has finished the drop detection process, the carriage moves to position the second printhead over the drop detection device. The same process is repeated for all the printheads. With respect to the process for each printhead, a first nozzle to be detected is fired. The drop detection device detects drops from the first nozzle. Then a second nozzle to be detected is fired. This process is repeated with all the nozzles on the particular printhead.

There are several disadvantages associated with existing drop detection methods. One of which is that only one nozzle can be detected at the same time. This is especially pertinent considering that the number of printheads and nozzles per printer has increased throughout the years. Furthermore, future printheads may have up to sixteen times more nozzles than present, and the present arrangements in which only one nozzle is evaluated at a time may adversely affect the efficiency of printing processes. Therefore, present methods of drop detection can be categorized as low throughput methods.

SUMMARY OF THE INVENTION

In one respect, the invention is a method for ascertaining the operational status of printhead nozzles. The method includes the step of firing a plurality of the nozzles. In this respect, the plurality of nozzles are fired substantially simultaneously. The method for ascertaining the operational status of the printhead nozzles also includes the step of detecting the substantially simultaneously fired ink drops. The method further includes the step of determining the status of each of the plurality of printhead nozzles. Nozzle status is determined based on results from the detecting step.

In another respect, the invention is a drop detection arrangement for monitoring a plurality of printhead nozzles. The drop detection arrangement includes a printhead arrangement with at least one printhead. Each printhead has a plurality of nozzles. In this respect, the drop detection arrangement also includes a drop detector for detecting ink drops that are substantially simultaneously ejected from the plurality of nozzles. The drop detection arrangement also includes a microprocessor. The microprocessor is configured to determine the nozzle status of each of the plurality of nozzles based on the detected ink drops.

In yet another respect, the invention is a method for testing the nozzles of a printhead arrangement. In this respect, the method includes choosing a group of nozzles to be fired. The method also includes selecting a group of nozzles to be fired and firing the selected nozzles substantially simultaneously. In this respect the method also includes the step of detecting the substantially simultaneously fired ink drops. The method also includes the step of determining the status of each of the selected nozzles based on the detection of the ink drops.

In comparison to known prior art, certain embodiments of the invention are capable of achieving certain aspects, including some or all of the following: performing high throughput drop detection; and increased print quality and product reliability. Those skilled in the art will appreciate these aspects of various embodiments of the invention upon reading the following detailed description of a preferred embodiment with reference to the below-listed drawings.

DETAILED DESCRIPTION OF A PREFERRED EMBODIMENT

Figure 1A:
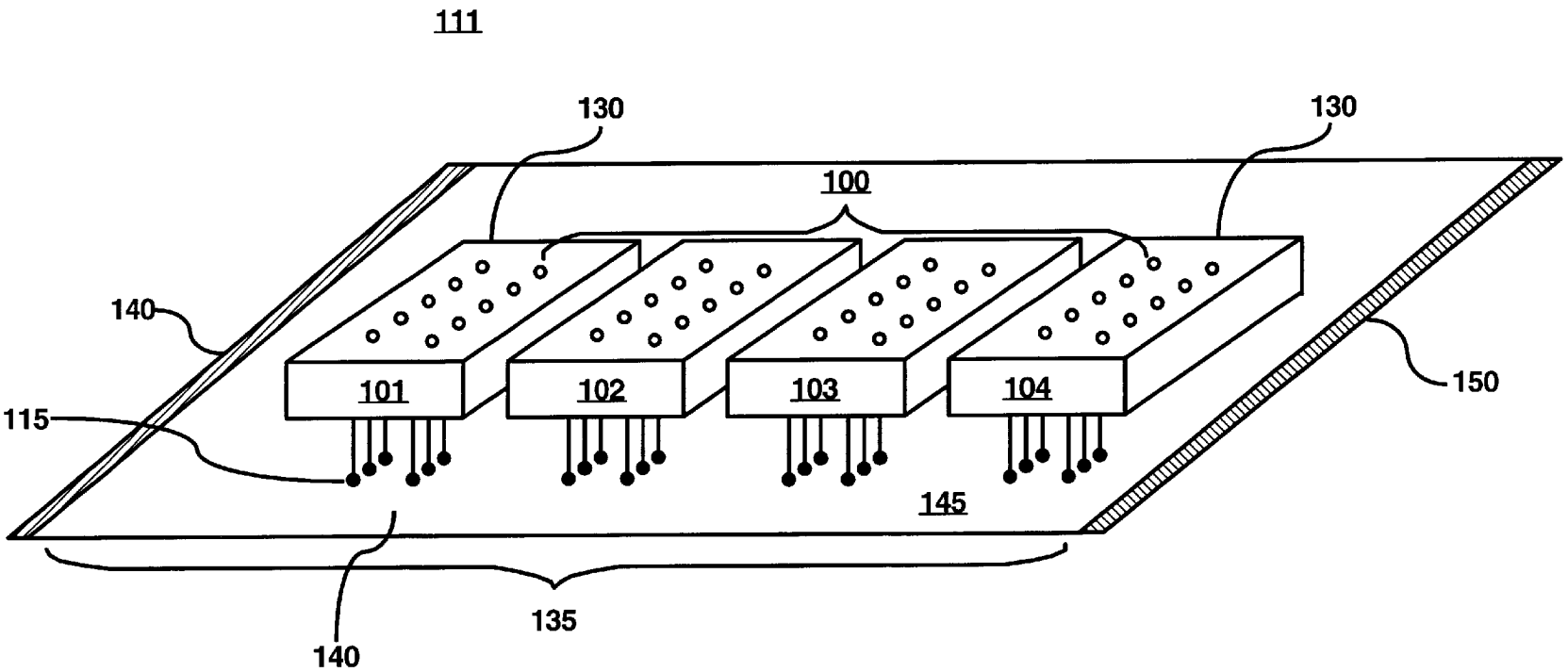
FIG. 1A is an exemplary perspective view showing a drop detection arrangement for a printer according to a first embodiment of the invention.

FIG. 1A is a perspective view showing an example of a drop detection arrangement 111 for a printer according to a first embodiment of the invention. The figure illustrates a printhead arrangement 100 and a sensing arrangement 135. FIG. 1A shows the printhead arrangement 100 in a testing position, i.e., a location at which the printhead arrangement 100 may be analyzed. The printhead arrangement of FIG. 1A has four printheads, 101, 102, 103, and 104. The printheads have a plurality of nozzles 130 for firing ink drops. The nozzles 130 may be arranged in rows and columns. The printheads may be conventionally supported on a carrier (not shown) to position the printheads for firing and testing of the nozzles 130. It should be noted that although the printhead arrangement 100 contains four printheads 101, 102, 103, and 104, FIG. 1A is merely an illustrative example, and the printhead arrangement may contain any reasonable number of printheads. For example, the printhead arrangement may have only one printhead or it may have eight printheads. Typically, multi-color inkjet printhead arrangements carry four printheads, yellow, magenta, cyan, and black.

The sensing arrangement 135 includes a light source 140 and a photodetector 150. The light source 140 is arranged to emit light in a parallel plane below the printhead arrangement. The light source may include, LEDs or laser illumination devices, or the like. These may work in combination with an optical lens or polarizing device to direct the light into a flat plane. FIG. 1A shows a flat light plane 145 formed by the light source 140. FIG. 1A also shows a photodetector 150, located in the same plane as the plane of light 145, for detecting light from the light source 140. The photodetector 150 may be a CCD (Charged Coupled Device) array, such as those conventionally used in scanners. The plane of light 145 extends from the light source 140 to the photodetector 150. The plane of light has a width that is perpendicular to the direction the light travels. The width of the plane of light may be up to 400 mm. Preferably, the light plane 145 is oriented in a horizontal plane, however, the light plane 145 may also be oriented at an angle to the horizontal.

FIG. 1A shows ink drops 115 that are substantially simultaneously ejected by the nozzles 130 in the printhead arrangement 100. As the ink drops 115 fall, they substantially simultaneously break the light plane 145. When the drops 115 break the light plane 145 they create shadows that alter the intensity of the light received by the photodetector 150.

Figure 1B:
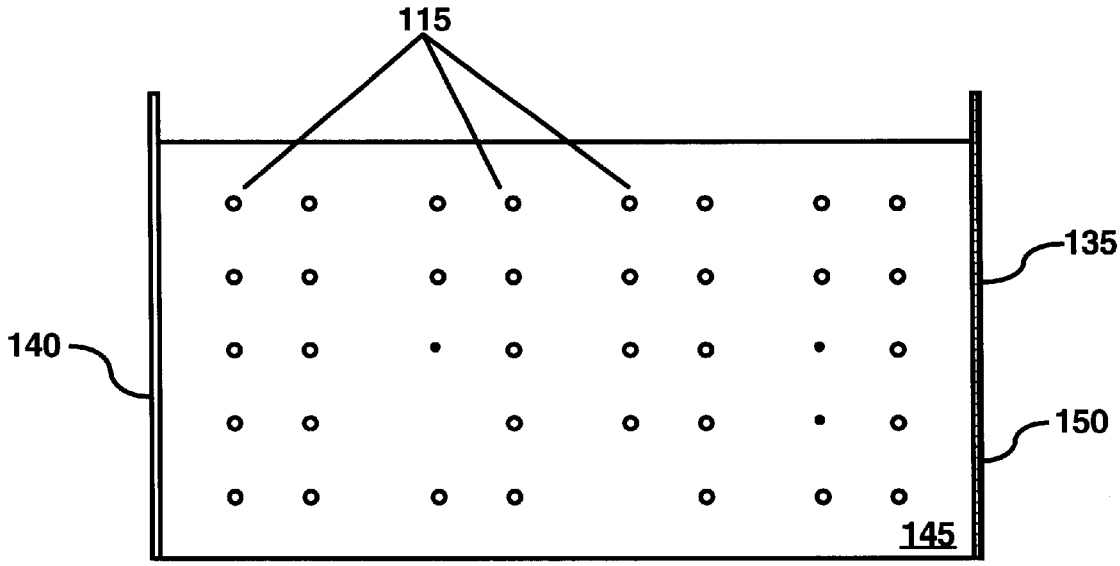
FIG. 1B is an exemplary top view of the sensing arrangement according to the first embodiment of the invention.

FIG. 1B is an exemplary top view of the sensing arrangement 135 according to the first embodiment of the invention. FIG. 1B shows the light source 140 positioned opposite to the photodetector 150, with the light plane 145 there between. Ink drops 115 of various sizes are shown as they break the light plane 145. FIG. 1B also shows areas where ink drops 115 are absent. It should be noted that the light plane 145 is positioned so that generally, all ink drops 115 eventually break the plane of light 145 after they exit the respective nozzles 130.

As stated above, the photodetector 150 may be a CCD array. Typically the CCD array 150 may have a plurality of cells that provide the sensing functions. The CCD array 150 by means of the plurality of cells detects the light in its various intensities. Each ink drop 115 is identified from the detected light intensity of a group of one or more cells of the CCD array 150. Based on the various light intensities the CCD electronics determines ink drop characteristics such as the presence and/or absence of ink drops, the size of the drops, and the falling angle of the ink drops. A predetermined low threshold light intensity may indicate the presence of an ink drop 115. Similarly, a predetermined high threshold may indicate the absence of an ink drop 115. Light intensities may also indicate other ink drop characteristics such as, size and position.

A microprocessor (not shown) associated with the CCD array 150 may determine the status of the printhead nozzles 130 based on the characteristics of the ink drops 115. For instance, the absence of an ink drop 115 may indicate that a nozzle failed to fire or is misfiring. The presence an ink drop 115 may indicate that the nozzle is firing. The size of the ink drop provides further information pertaining to the working status of the nozzle. An ink drop 115 that is smaller than usual indicates that a particular nozzle may be partially clogged or misfiring. The location of an ink drop 115 may also provide further information. An ink drop that is in an unusual position or angle may suggest that the nozzle is skewed.

For the drop detection arrangement 111 of FIG. 1A, it should be noted that the nozzles may not all be tested at the same time. The nozzles may be tested in groups. Whether or not the nozzles 130 are tested in groups depends on several factors. These factors may include the number of printheads in the printhead arrangement, the number of nozzles per printhead, the distance between nozzles, the number and arrangement of cells in the CCD array 150, and the number of cells affected by a single ink drop 115. For instance, nozzles that produce ink drops that are too close may not be fired simultaneously. A microprocessor associated with the printer may be used to control the process of choosing and firing the appropriate groups of nozzles.

Figure 2A:
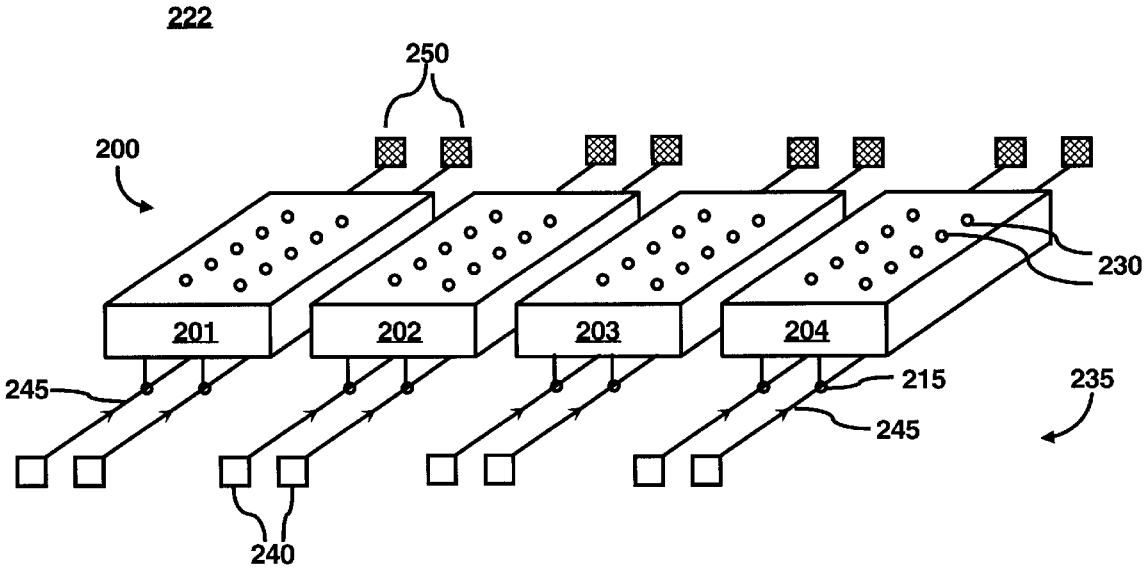
FIG. 2A is an exemplary perspective view showing a drop detection arrangement for a printer according to a second embodiment of the invention.

FIG. 2A is a perspective view showing an example of a drop detection arrangement 222 for a printer according to a second embodiment of the invention. FIG. 2A illustrates a printhead arrangement 200 and a sensing arrangement 235. FIG. 2A shows the printhead arrangement 200 in a testing position, i.e., a location at which the printhead arrangement 200 may be analyzed. The printhead arrangement of FIG. 2A has four printheads, 201, 202, 203, and 204. The printheads have a plurality of nozzles 230 for firing ink drops. The nozzles may be arranged in rows and columns. FIG. 2A shows two columns of nozzles 230. As in the first embodiment, the printhead arrangement 200 may be conventionally supported on a carrier (not shown) and may contain any reasonable number of printheads. For example, the printhead arrangement may have only one printhead or it may have eight printheads.

The sensing arrangement 235 includes an array of light sources 240 and a corresponding array of photodetectors 250. Each light source 240 is arranged to emit a light beam to a particular photodetector 250. The sensing arrangement 235 is arranged below the printhead arrangement 200 in order to detect ink drops fired from the plurality of nozzles. The light sources may comprise LEDs, laser illumination devices or the like. FIG. 2A shows a plurality of light beams 245 formed by the light sources 240. The light beams 245 are in a plane generally perpendicular to the path followed by ejected ink drops 215. The photo sensors 250 may be a photodiode or the like. Each beam of light 245 extends from the light source 240 to the photodetector 250. Typically, the array of light sources 240 and the array of photodetectors 250 are arranged so that light beams 245 are substantially parallel to each other. The light beams 245 may be projected so that they are parallel to nozzle columns. Preferably, the light beams 245 are oriented in a horizontal plane, however, the light beams 245 may also be oriented at an angle to the horizontal FIG. 2A shows ink drops 215 that are substantially simultaneously ejected by the nozzles 230 in the printhead arrangement 200. As the ink drops 215 fall, they substantially simultaneously break the beams of light 245. When the ink drops 215 break the different beams of light 245, they create shadows that alter the intensity of light received by the photodetectors 250. The photodetectors 250 detect the changes in light intensity.

Figure 2B:
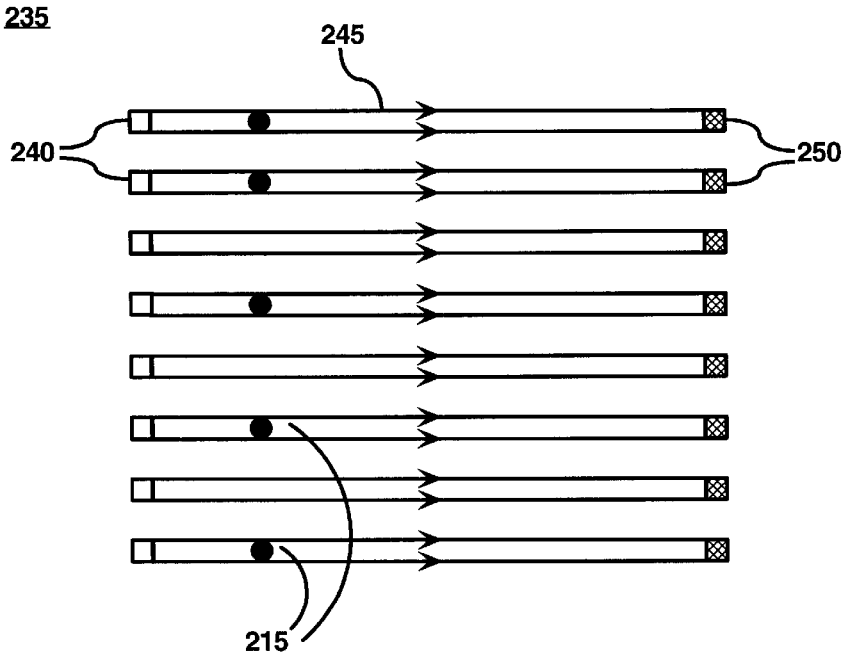
FIG. 2B is an exemplary top view of the sensing arrangement according to the second embodiment of the invention.

FIG. 2B is an exemplary top view of the drop sensing arrangement 235 according to the second embodiment of the invention. FIG. 2B shows each of the light sources 240 positioned opposite to one of the photodetectors 250, with beams of light 245 there between. Ink drops 215 of various sizes are shown as they break the beams of light 245. FIG. 2B also shows areas where ink drops 215 are absent. It should be noted that the beams of light 245 are positioned so that generally, each ink drop 215 eventually breaks a beam of light 245 after the ink drop 215 exits the respective nozzle 230. It should also be noted that the ink drops 215 illustrated in FIG. 2B, are representative of ink drops ejected from a particular column of nozzles.

As stated above, the photodetector 250 may be a photodiode or the like. The photodetector 250 may detect light in its various intensities. The photodetector 250 may determine ink drop characteristics such as the presence and/or absence of ink drops. The photodetector 250 may also detect generally abnormal ink drops 115, i.e., ink drops 115 that are different from regular ink drops.

A microprocessor associated with the photodetector 250 may be used to determine the status of the printhead nozzles 230 based on the characteristics of the ink drops 215. For instance, the absence of an ink drop 215 may indicate that a nozzle failed to fire or is misfiring. The presence of an ink drop 115 may indicate that the nozzle is firing. The detection of an abnormal ink drop may indicate that the related nozzle is misfiring in some way.

For the drop detection arrangement 222 of FIG. 2A, it should be noted that the nozzles are preferably tested in groups. In one embodiment, the sensing arrangement 235 is linear in nature with each light source/photodetector combination able to accurately detect ink drops fired by one nozzle at a time per column of the plurality of nozzles 230. Therefore, for best results, only one nozzle of each column may be tested at a time. A microprocessor (not shown) associated with the printer may be used to control the process of choosing and firing the appropriate columns of nozzles.

Figure 3:
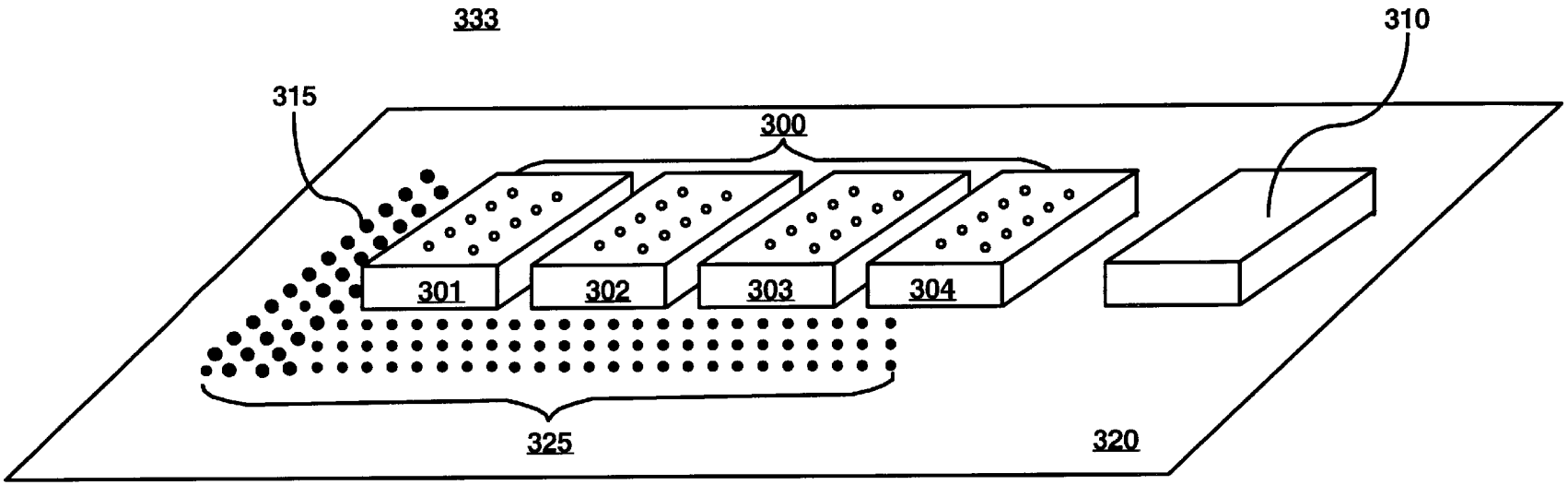
FIG. 3 is an exemplary drop detection arrangement for a printer according to a third embodiment of the invention.

FIG. 3 is an example of a drop detection arrangement 333 according to a third embodiment of the invention. FIG. 3 illustrates a printhead arrangement 300 in combination with a scanner 310. The printhead arrangement of FIG. 3 has four printheads, 301, 302, 303, and 304. The printheads have a plurality of nozzles for firing ink drops. As in the first embodiment, the printhead arrangement 300 may be conventionally supported on a carrier (not shown) and may contain any reasonable number of printheads.

FIG. 3 also shows the scanner 310 located downstream of the printhead arrangement 300. The scanner 310 is positioned above a substrate 320 containing a test pattern 325 of ink drops 315. The scanner may be attached to the printhead carrier (not shown) or may be positioned in a testing location where it is in a position to scan the ink drops 315 on the substrate 320. Essentially, the scanner 310 may be located in any position where it can effectively read the test pattern 325. As illustrated in FIG. 3, the substrate 320 with the test pattern 325 is fed past the scanner 310. Alternatively, the scanner 310 may be fed past the substrate 320, or both scanner 310 and substrate 320 may be in motion at the same time.

In this embodiment, the scanner 310 scans the ink drop test pattern 325. The scanner 310 may have a CCD for capturing ink drop image data. Ink drop characteristics identified from the ink drops 315 in the test pattern 325 on the substrate 320 is used to analyze the working status of the nozzles. For instance, the absence of an ink drop may indicate that a nozzle failed to fire or is misfiring. The presence of an ink drop may indicate that the nozzle is firing. The size and shape of the ink drop may provide further information pertaining to the working status of the nozzle. An ink drop that is smaller than usual indicates that a particular nozzle may be partially clogged or misfiring. A larger than usual ink drop 315 also indicates that the particular nozzle may be misfiring. The location of an ink drop may also provide further information, such as nozzle skew or misalignment. After reading the test pattern, the scanner 310 transmits a signal indicative of the ink drop data.

With regards to the embodiment illustrated in FIG. 3, it should be noted that all the nozzles in the printhead arrangement 300 may be fired substantially simultaneously to produce the ink drop test pattern 315. The scanner 310 can read the entire test pattern 225 in a single pass as the substrate 320 with the test pattern 325 is fed past the scanner 310. The scanner 310 may also read the pattern in a plurality of passes, if desired.

Figure 4:
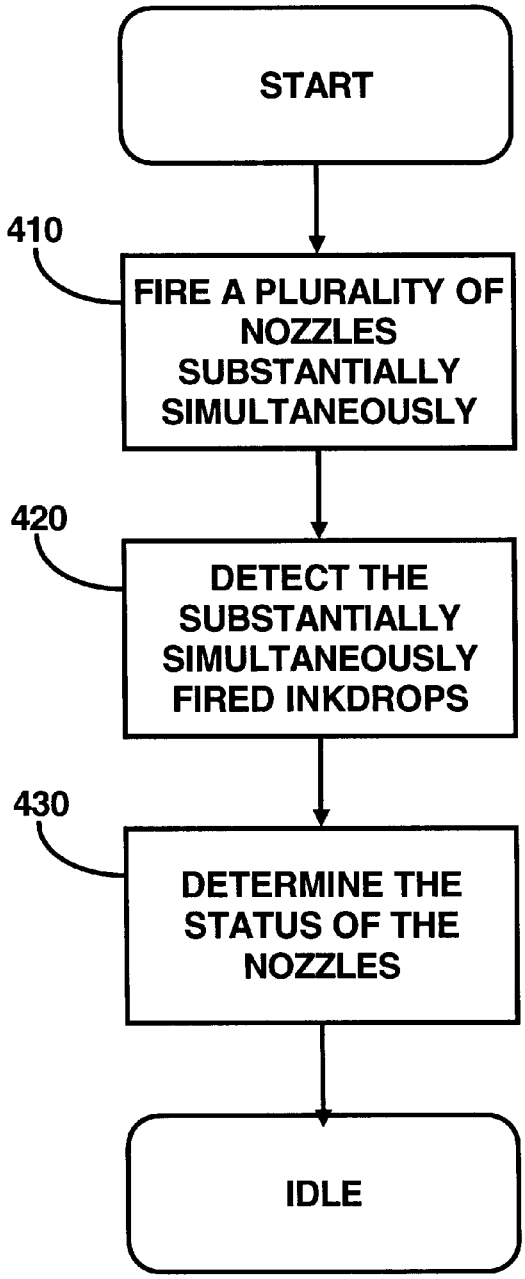
FIG. 4 is a flowchart illustrating a method of determining the operational status of printhead nozzles.

FIG. 4 is a flowchart illustrating an exemplary method 400 of determining the operational status of printhead nozzles. The flowchart illustrates a general overview method according to all the previously described embodiments of FIGS. 1–3. A microprocessor associated with the printer may be used to control the printer testing functions for determining the operational status of the nozzles.

As illustrated in FIG. 4, the method 400 begins with step 410, the firing of a plurality of nozzles. The nozzles are fired substantially simultaneously so that ink drops are ejected at substantially the same time. Typically, in order to carry out step 410, the printheads are first warmed up. This warming up usually requires each nozzle to spit 10–50 ink drops, before the actual drops for testing are fired. Each nozzle may fire one or more drops to create a test pattern, which is later analyzed to determine the status of a nozzle. For example, a pattern may include one drop or a line of drops ejected from each nozzle for easy detection.

As previously outlined, depending on the drop detection arrangement, the nozzles may not all be fired at the same time. In some instances, more accurate results may be obtained when the nozzles are divided into groups, and these groups are tested one at a time. A microprocessor associated with the printer may be used to control the process of choosing and firing the appropriate groups of nozzles.

After the nozzles are fired in step 410, the following step 420 is the detection of the substantially simultaneously fired ink drops. As outlined above, the ink drops may be detected by a CCD array 150 that detects when the ink drops break a horizontal light plane 145. Alternatively, the ink drops may be detected by an array of sensors 250 that detects when the ink drops break horizontal light beams 245. Also, a scanner 310 that reads a test pattern 325 of ejected ink drops may be used to detect the ejected ink drops.

The detecting step 420 also includes the recognition of ink drop characteristics. The above described drop detection arrangements are all configured to recognize ink drop characteristics such as presence or absence of ink drops. The arrangements may also recognize ink drop characteristics that deviate from the norm.

Step 430 is the determining of the status of the nozzles. Nozzle status is determined based on the results obtained from the step 420 of detecting the substantially simultaneously fired ink drops. A microprocessor may be used to correlate particular ink drop characteristics to the status of the nozzle from which the ink drop was ejected. For example, an absent ink drop may indicate that it was ejected from a clogged or misfiring nozzle. Therefore, the ink drop characteristics are used by each drop detection arrangement to determine the status of printhead nozzles. As illustrated in FIG. 4, after determining the status of the printhead nozzles in step 430, the process 400 goes into an idle state. It should be noted that the process 400 may be repeated as often as required until all the nozzles are tested.

Figure 5:
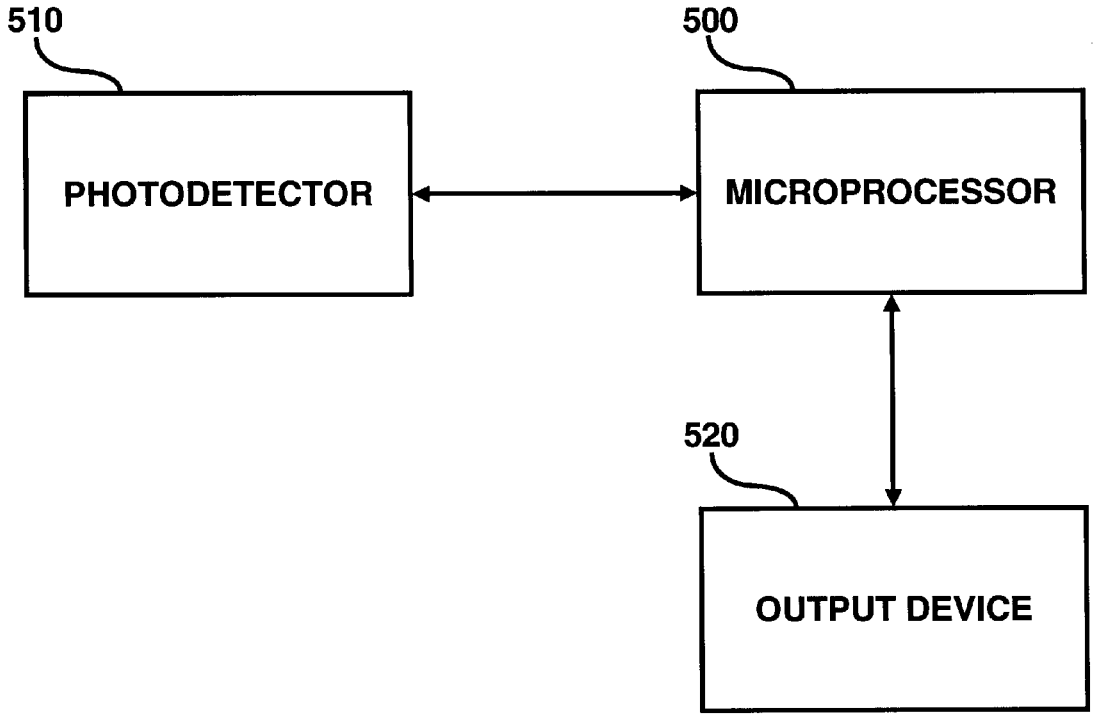
FIG. 5 is an exemplary illustration of an arrangement used to determine nozzle status.

FIG. 5 is an exemplary illustration of an arrangement used in step 430, the determination of the status of the printhead nozzles. The arrangement of FIG. 5 may be generally employed in all the previously outlined drop detection arrangements. FIG. 5 shows a microprocessor 500 interfaced with a photodetector 510 and an output device 520.

As outlined above, the photodetector 510 may be a photodiode or a CCD or the like, and is used to detect ink drops that are substantially simultaneously ejected from printhead nozzles. The photodetector 510 is representative of any of the photodetecting devices used in the drop detection arrangements outlined above and illustrated in FIGS. 1–3. The microprocessor 500 may be a printer microprocessor providing printer functionality. The microprocessor may also be solely associated with the photodetector 510. In any event, the microprocessor 500, receives signals from the photodetector 510, the signals indicative of ink drop characteristics. The microprocessor 500 correlates the ink drop characteristics to nozzle status, thereby determining the status of the nozzles. The microprocessor then transmits the results to an output device. The output device may be a display, a speaker, a host device, a host device, or the like.

What has been described and illustrated herein is a preferred embodiment of the invention along with some of its variations. The terms, descriptions and figures used herein are set forth by way of illustration only and are not meant as limitations. In general, any known light source may be used to produce the light plane and the beams of light described herein above. Also, other types of detecting devices may be implemented. Furthermore, the light plane 145 and the light beams 245 may be oriented at angles to the horizontal if desired. Those skilled in the art will recognize that many variations are possible within the spirit and scope of the invention, which is intended to be defined by the following claims and their equivalents in which all terms are meant in their broadest reasonable sense unless otherwise indicated.

What is claimed is:

1. A method for ascertaining the operational status of printhead nozzles, the method comprising:

firing a plurality of the nozzles substantially simultaneously;

detecting the substantially simultaneously fired ink drops; and determining a status of each of the plurality of printhead nozzles based on results from the detecting step.

2. The method of claim 1, wherein the step of detecting the substantially simultaneously fired ink drops comprises:

projecting light from a light source to a photodetector, the light being projected in a horizontal light plane wherein the horizontal light plane intersects the path of the substantially simultaneously fired ink drops.

3. The method of claim 2, wherein the step of detecting the substantially simultaneously fired ink drops further comprises:

sensing variations in light intensity, wherein the variations in light intensity are created when the substantially simultaneously fired ink drops break the horizontal light plane; and determining ink drop characteristics from the variations in light intensity.

4. The method of claim 3, wherein the ink drop characteristics comprise at least one of, ink drop presence, ink drop absence, ink drop size, and ink drop location.

5. The method of claim 4, wherein the step of determining the status of each of the printhead nozzles comprises correlating the ink drop characteristics with nozzle status.

6. The method of claim 1, wherein the step of detecting the substantially simultaneously fired ink drops comprises:

projecting a plurality of light beams from a plurality of light sources to a corresponding plurality of photodetectors, the light beams projected in a horizontal plane wherein the horizontal light beams intersect the path of at least one of the substantially simultaneously fired ink drops.

7. The method of claim 6, wherein the step of detecting the substantially simultaneously fired ink drops further comprises:

sensing variations in light intensity, wherein the variations in light intensity are created when the substantially simultaneously fired ink drops break the horizontal beams of light; and determining ink drop characteristics from the variations in light intensity.

8. The method of claim 7, wherein the ink drop characteristics comprise at least one of, ink drop presence ink drop absence, ink drop size, and ink drop abnormality.

9. The method of claim 8, wherein the step of determining the status of each of the printhead nozzles comprises correlating the ink drop characteristics to nozzle status.

10. The method of claim 1, further comprising the step of creating a test pattern from the substantially simultaneously fired ink drops, wherein the test pattern comprises ink drops and is created on a substrate.

11. The method of claim 10, wherein the step of detecting the substantially simultaneously fired ink drops comprises:

scanning the test pattern to detect ink drop characteristics from the ink drops that comprise the test pattern.

12. The method of claim 10, wherein the ink drop characteristics comprises at least one of, ink drop presence, ink drop absence, ink drop size, and ink drop skew.

13. The method of claim 12, wherein the step of determining the status of each of the printhead nozzles comprises correlating the ink drop characteristics to nozzle status.

14. A drop detection arrangement for monitoring a plurality of printhead nozzles, the arrangement comprising:

a printhead arrangement with at least one printhead, each printhead comprising a plurality of nozzles;

a drop detector for detecting ink drops substantially simultaneously ejected from the plurality of nozzles; and a microprocessor configured to determine the nozzle status of each of the plurality of nozzles based on the detected ink drops.

15. The arrangement of claim 14, wherein the drop detector comprises:

a light source for emitting light;

a CCD array positioned to detect light intensity, and wherein the microprocessor determines the nozzle status based on the light intensity detected by the CCD array.

16. The arrangement of claim 15, wherein the light source is located on one side of the printhead arrangement and the CCD array is located on another side of the printhead arrangement, forming a plane of light that extends form the light source to the CCD array.

17. The arrangement of claim 16, wherein plane of light has a width perpendicular to the direction the light travels, the width being 400 mm.

18. The arrangement of claim 14, wherein the drop detector comprises:

an array of light sources providing substantially parallel light beams in a horizontal plane an array of photodetectors for detecting light intensities, wherein each photodetector in the array of photodetectors is aligned with a corresponding light source in the array of light sources, and wherein the microprocessor determines the nozzle status based on the light intensities detected by the array of photodetectors.

19. The arrangement of claim 18, wherein the array of light sources is located on one side of the printhead arrangement and the array of photodetectors is arranged on another side of the printhead, and wherein each aligned photodetector and corresponding light source is arranged parallel to a nozzle column.

20. The arrangement of claim 14, wherein the drop detector comprises:

a scanner arranged downstream of the printhead arrangement for scanning a test pattern of substantially simultaneously fired ink drops.

21. A method for testing the nozzles of a printhead arrangement, the method comprising:

selecting a group of nozzles to be fired;

substantially simultaneously firing ink drops from the selected nozzles; and detecting the substantially simultaneously fired ink drops;

determining the status of each of the selected nozzles based on the detection of the ink drops.

22. The method of claim 21, wherein the step of detecting the substantially simultaneously fired ink drops comprises:

projecting light in a light plane, wherein the light plane intersects the path of the substantially simultaneously fired ink drops;

sensing variations in light intensity wherein the variations in light intensity are created when the substantially simultaneously fired ink drops break the light plane; and determining ink drop characteristics from the variations in light intensity.

23. The method of claim 21, wherein the step of detecting the substantially simultaneously fired ink drops comprises:

projecting a plurality of light beams wherein the plurality of light beams intersect the path of at least one of the substantially simultaneously fired ink drops;

sensing variations in light intensity wherein the variations in light intensity are created when the substantially simultaneously fired ink drops break the light beams; and determining ink drop characteristics from the variations in light intensity.

24. The method of claim 21, wherein the substantially simultaneously fired ink drops create a test pattern on a substrate and the step of detecting comprise scanning the test pattern with a scanner.

* * * * *

UNITED STATES PATENT AND TRADEMARK OFFICE

CERTIFICATE OF CORRECTION

PATENT NO. : 6,648,444 B2
DATED : November 18, 2003
INVENTOR(S) : Valero et al.

It is certified that error appears in the above-identified patent and that said Letters Patent is hereby corrected as shown below:

Column 2,
Lines 1 and 3, replace "DESIGNJET™" with -- DESIGNJET® --.

Signed and Sealed this

Thirtieth Day of March, 2004

JON W. DUDAS
*Acting Director of the United States Patent and Trademark Office*